United States Patent [19]

Redman

[11] 4,086,511

[45] Apr. 25, 1978

[54] MILLIMETER IMAGING DEVICE

[75] Inventor: Charles M. Redman, Las Cruces, N. Mex.

[73] Assignee: The United States of America as represented by the Secretary of the Army, Washington, D.C.

[21] Appl. No.: 781,255

[22] Filed: Mar. 25, 1977

[51] Int. Cl.[2] ..... H01J 39/18; H01J 31/50

[52] U.S. Cl. ..... 313/101; 250/333; 313/388

[58] Field of Search ..... 313/101, 388; 250/330, 250/333

[56] References Cited

U.S. PATENT DOCUMENTS

| | | | |
|---|---|---|---|
| 2,999,177 | 9/1961 | Null et al. | 313/388 |
| 3,524,016 | 8/1970 | Jacobs et al. | 250/330 X |
| 3,885,187 | 5/1975 | Schnitzler | 313/101 X |
| 3,950,645 | 4/1976 | Rotstein et al. | 250/333 X |
| 4,031,393 | 6/1977 | Redman | 250/333 X |

*Primary Examiner*—Robert Segal

*Attorney, Agent, or Firm*—Nathan Edelberg; Robert P. Gibson; Saul Elbaum

[57] ABSTRACT

An imaging device for detecting reflections of millimeter waves from a target. The imaging device includes a composite cathode for converting an input radiation image to an electron image by field emission, a focusing lens to demagnify the image, and an amplifier and storage plate spaced from the composite cathode for detecting, storing and transferring the electron image to a viewing screen or recording medium.

10 Claims, 4 Drawing Figures

MILLIMETER IMAGING DEVICE

RIGHTS OF THE GOVERNMENT

The invention described herein may be manufactured, used and licensed by or for the United States Government for governmental purposes without the payment to me of any royalty thereon.

BACKGROUND OF THE INVENTION

1. Field of the Invention

The present invention relates to electron image photography for high performance night and all-weather application.

2. Description of the Prior Art

The range of transmission of electromagnetic radiation through the atmosphere varies with the wavelength of the radiation and the weather conditions. Thus, rain and fog can attenuate optical wavelengths drastically, but leave some longer wavelengths relatively unaffected. This is in part due to the reduction in Mie and Rayleigh scattering at the longer wavelengths. The possibility of using millimeter waves for high-performance night and allweather imaging systems has been discussed in the paper, B. Levin and B. Feingold, "All-Weather Eye Opens Up With Millimeter Wave Imaging", Electronics, Aug. 17, 1970, pages 82–87. These authors note that absorption, caused by the resonant behavior of the water vapor and oxygen molecules, accounts for most of the attenuation in the millimeter-wave range. However, a number of low-attenuation windows exist in the millimeter band centered at 35 GHz. (8.6 millimeters), 94 GHz. (3.2 millimeters), 140 GHz. (2.15 millimeters), 240 GHz. (1.25 millimeters), and 28.3 THz. (10.6 microns). There are no perfect windows, but there are best selections. Thus, one of the best windows for clear air, light fog, and light and heavy rain conditions is at 10.6 microns. However, a heavy fog blocks it at 50 decibels per kilometer. The 1.25 millimeter window has 28 decibels per kilometer loss in heavy fog but is not as good as the 10.6 micron window for other weather conditions.

Until recently little has been done with the millimeter wave region. A known prior art millimeter imaging device utilizes a Germanium panel and a raster screen readout system.

BRIEF SUMMARY OF THE INVENTION

It is therefore one object of the present invention to provide an improved millimeter wave imaging device.

It is another object of the present invention to provide such a device which can operate with electromagnetic radiation at any wavelength from optical to 10 millimeters or longer.

The objects of the present invention are achieved by a millimeter wave imaging device. The millimeter wave imaging device includes field emission means responsive to the application of an external electric field thereto for emitting a carrier wave of electrons, and modulating means connected to the field emission means and responsive to absorption of power from an input radiation image for modulating the carrier wave of electrons to convert the input radiation image to an electron image. The device further includes storage means spaced from the field emission means for detecting and temporarily storing the electron image, accelerating means for directing the emitted electron carrier wave onto the storage means, amplifier means connected to the storage means for amplifying the stored electron image, and display means disposed at the output of the amplifier means for displaying the amplified electron image.

The millimeter wave imaging device of this invention makes possible the use of millimeter and submillimeter electromagnetic radiation for imaging with image quality approaching that of optical imaging.

The foregoing as well as other objects, features and advantages of the present invention will become more apparent from the following detailed description taken in conjunction with the appended drawings.

DETAILED DESCRIPTION

Figure 1:
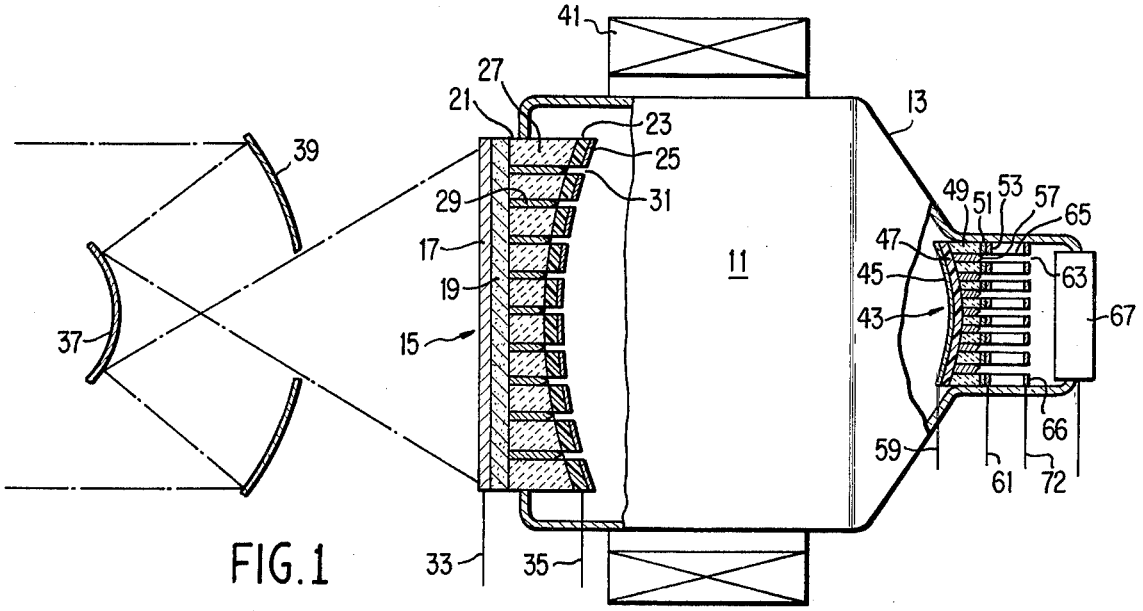
FIG. 1 is a schematic diagram of a millimeter wave imaging device in accordance with the teachings of this invention.

Referring now to the drawing and more particularly to FIG. 1 thereof, there is illustrated in schematic form a millimeter wave imaging tube generally indicated by the reference numeral 11. The tube includes a closed axially symmetric glass envelope 13 which is evacuated to a high vacuum. The left end of the envelope is closed by a transversely mounted composite cathode 15. Structurally, the composite cathode includes an outward side consisting of a conductor 17 coated on a pyroelectric film 19. The pyroelectric film is preferably triglycene sulfate (TGS), but less sensitive film such as polyvinyl fluoride which are easier to deposit can be utilized. The conductor 17 is transparent to millimeter wave radiation. A flat black or EMF absorbing film when used for the conductor may improve its performance by more efficient absorption of input radiation. The inward side of the composite cathode 15 consists of a fiber plate 21, an insulating grid 23 in contact with the fiber plate, and a conducting grid 25 coated on the insulating grid. The fiber plate 21 consists of an oxide matrix 27 containing a plurality of axially aligned metallic fibers 29. The insulating grid 23 is composed of an insulating film, preferably aluminum oxide, with a series of spaced and adjacent apertures 31 formed therein and coinciding with the tips of the metallic fibers 29. The conducting grid 25 is composed of a conducting film, preferably of aluminum. The conducting grid has apertures that are in register with the apertures 31 of the insulating grid so that the tips of the metallic fibers 29 are exposed to the inside of the millimeter wave imaging tube.

The conductor 17 and the conducting grid 25 are provided with leads 33 and 35 so that a high frequency electric field, for example at 10 MHz., can be applied across the composite cathode 15. The amplitude of the electric field is chosen to cause field emission of electrons from the tips of the metallic fibers 29 during the peak excursions of the electric field strength. As a result, an electron carrier wave for image information is produced, consisting of packets of electrons emitted from the tips of the fibers axially along the inside of the imaging tube at the frequency of the applied electric field.

A beam of millimeter waves at, for example, 300 GHz is radiated onto the scene being viewed. The radiation reflected from objects at the scene is collected by a conventional system of reflectors 37 and 39 and imaged on the composite cathode 15. A local oscillator signal, such as 300.0005 GHz is also focused on the composite cathode. The 300.0005 GHz. wave can be generated using well-known prior art techniques. One technique which can be utilized is that of Bragg diffraction of a 300 GHz. wave from a 0.5 MHz. wave which is acoustically coupled into a $TeO_2$ crystal.

The pyroelectric film 17 of the composite cathode 15 detects the power in the beat frequency signal at 0.5 MHz. and uses it to modulate the amplitude of the 10 MHz. electron carrier wave. As a result, the image information is carried in the envelope of the electron carrier wave generated by the metallic fibers 29. The radiation image is thereby converted to an electron image which is projected axially along the inside of the imaging tube 11.

An electrostatic or electromagnetic focusing lens 41 is concentrically mounted about the central portion of the imaging tube. Leads are connected to the focusing lens 41 to apply potentials thereto. The purpose of the focusing lens is to demagnify the image while keeping the image order as projected by the composite cathode 15.

At the right end of the tube 11 is transversely mounted an amplifier and storage plate, generally indicated by the reference numeral 43. The inward portion of this plate consists of a conductor 45 coated on a semiconducting film 47. The semiconducting film is coated on one end of a first fiber plate 49, and an insulating grid 51 is coated on the other end of the fiber plate. The fiber plate 49 consists of an oxide matrix containing a plurality of axially aligned metallic fibers 57. The conducting grid 53 is composed of a conducting film, preferably aluminum, with a series of spaced and adjacent apertures in register with the tips of the metallic fibers 57 which are exposed at the surface of the oxide matrix. The conductor 45 is provided with a lead 59 for the application of a potential $E_1$ to provide an accelerating voltage between the amplifier and storage plate 43 and the composite cathode 15. The conducting grid 53 is also provided with a lead 61 to apply a potential $E_2$ thereto. The outward portion of the amplifier and storage plate 43 consists of a second fiber plate 63 identical in all respects to the first fiber plate 49 except that the fibers have been removed, leaving a plurality of micro-channels 65 in the oxide matrix 63 in register with the metallic fibers 57 of the first fiber plate 49. The micro-channels 65 are lined with a very thin layer of a suitable secondary emissive material, such as a dielectric oxide to present surfaces having secondary emissive properties, and the oxide matrix 63 is coated at both ends with conducting grids 53, and 60, having apertures in line with the micro-channels and disposed in electrical contact with the interior surfaces of the channels. The outward facing conducting grid 66 is provided with a lead 72 to apply a potential $E_3$ thereto.

The electrons in the electron carrier wave, having been accelerated across the space between the composite cathode 15 and the amplifier and storage plate 43 by the difference in potential strike the semiconducting film 47 with an impact equivalent to about 10,000 electron-volts. For each electron which strikes the semiconducting film about 2,000 electron-hole pairs are created. By setting the potential $E_2$ at the conducting grid 51 slightly positive with respect to the potential $E_1$ at the conductor 45, the electrons are caused to migrate to the tips of the metallic fibers 57 where they are held and stored until a suitable voltage pulse is applied to the lead 61 to produce field emission. The electron image is then quickly transferred through the micro-channels of the plate toward the image output section 67 of the imaging tube 11 for visual readout. In the process, the electron image is further amplified by the multiplication of the electrons due to repeated collisions with the secondary emissive surfaces of the micro-channels 65.

An inductance (not shown) is connected between the conductor 45 and the conducting grid 51 to shunt the effective capacitance between these two members, and its reactance is selected so as to be equal to the capacitive reactance between these two members at 10 MHz. The lead 61 comprises a series capacitance and inductance (not shown) having equal reactances at 0.5 MHz. These circuits reject the 10 MHz. carrier, permitting the image information carried in the envelope with the electron carrier wave to be detected in the amplifier and storage plate 43.

Figure 2:
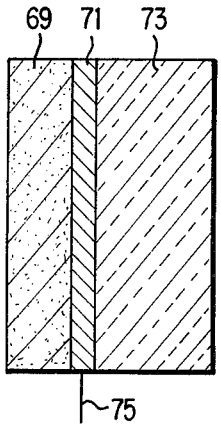
FIG. 2 is a schematic diagram of a direct readout type of image output section for a millimeter wave imaging device in accordance with the teachings of this invention.
Figure 3:
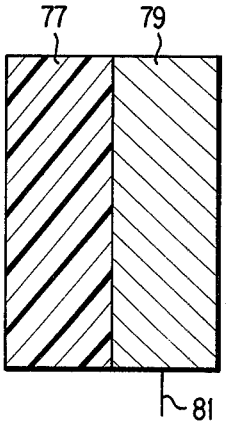
FIG. 3 is a schematic diagram of a direct recording type of image output section for a millimeter wave imaging device in accordance with the teachings of this invention.
Figure 4:
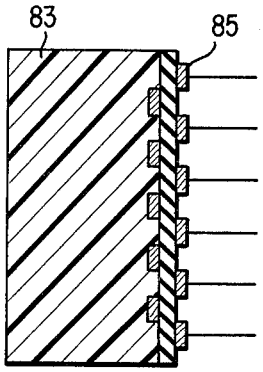
FIG. 4 is a schematic diagram of a storage type of image output section for a millimeter wave imaging device in accordance with the teachings of this invention.

FIGS. 2–4 show the image output section 67 according to each of three embodiments. The difference between the embodiments resides in the mode of readout.

Referring to FIG. 2, a direct readout type of image output section is shown comprising a phosphor output screen 69, a metal (thin enough to be transparent) film 71, and a glass substrate 73. The assembly is mounted in parallel, spaced relationship to the amplifier and storage plate 43. The metal film 71 is provided with a lead 75 to apply an accelerating potential $E_4$ thereto for accelerating electron flow toward the phosphor output screen to give a light image corresponding to the input radiation. An electron focusing lens can be provided to magnify or demagnify the electron image depending on the desired size of display.

Referring to FIG. 3, a direct recording type of image output section is shown comprising an electron-sensitive film 77 adapted for continuous motion past a conducting backplate 79. The assembly is mounted in parallel, spaced relationship to the amplifier and storage plate 43. In order to minimize dispersion of the electron image by air, the distance between the amplifier and storage plate and the film should be minimized. Conventional photonsensitive films can be used, although modern film technology permits a further optimization of electron images by a more sensitive electron film. Electrostatic type film or paper can be used. The backplate is provided with a lead 81 to provide an accelerating potential $E_4$ thereto for accelerating electron flow toward the film. Since the electron image is transferred to the moving film in very short bursts, the film motion does not blur the transferred image.

Referring to FIG. 4, a storage type of image output section is shown comprising a two-dimensional charge-coupled device (CCD) array, preferably mounted parallel to and in direct contact with the amplifier and storage plate 43. When an electron image is projected on the underside of the semiconductor substrate 83 of the CCD array, the holes created by the electron image will diffuse toward the electrode side of the device. There they can be stored in the potential wells created by the positively charged electrodes 85. The image can then be read out serially by the shift register action of the CCD array to an external television monitor.

The fiber plates 21, 49 and 63 of FIG. 1 can be fabricated using well-known prior art techniques. One fabrication approach which can be utilized is described in detail in the publication "Report No. 6: Melt Grown Oxide-Metal Composites" from the School of Ceramic Engineering, Georgia Institute of Technology, A.T. Chapman, Project Director (December 1973) and hereby incorporated by reference. The fiber plates are constructed from a melt grown oxide-metal composite consisting of about $10^7$ parallel metal fibers in each square centimeter of an oxide matrix. Preferred materials are tungsten for the fibers, and uranium dioxide for the oxide matrix, but other well-known materials can be utilized. The composite is grown in a resistance-induction furnace from a mix of oxide and of metal particles. Resistance heating brings the sample of mix close to the melting point. Induction heating melts a zone in the mix but does not melt the outside of the mix. The outer zone of the mix acts as a crucible to hold the melt. The melt particles drift to small zones of the metal. The melt zone is moved up through the mix and the metal zones form into wires or fibers. The composite is then cut to length and the outer zone as cut away.

I wish it to be understood that I do not desire to be limited to the exact details of construction shown and described, for obvious modifications can be made by persons skilled in the art.

What is claimed as new and desired to be secured by Letters Patent of the United States is:

1. A millimeter wave imaging device comprising:

field emission means responsive to application of an external electric field thereto for emitting a carrier wave of electrons;

modulating means connected to the field emission means and responsive to absorption of power from an input radiation image for modulating the carrier wave of electrons to convert the input radiation image to an electron image;

storage means spaced from the field emission means for detecting and temporarily storing the electron image;

accelerating means for directing the emitted electron carrier wave onto the storage means;

amplifier means connected to the storage means for amplifying the stored electron image; and display means disposed at the output of the amplifier means for displaying the amplified electron image.

2. The millimeter wave imaging device recited in claim 1 wherein the field emission means includes:

an oxide matrix; and a plurality of parallel metallic fibers contained in the oxide matrix.

3. The millimeter wave imaging device recited in claim 2 wherein the modulating means includes:

a pyroelectric film coated on the field emission means.

4. The millimeter wave imaging device recited in claim 1 wherein the storage means includes:

an oxide matrix;

a plurality of parallel metallic fibers contained in the oxide matrix; and a semiconducting film coated on one end of the oxide matrix and disposed in contact with the plurality of metallic fibers.

5. The millimeter wave imaging device recited in claim 1 wherein the amplifier means includes:

an oxide matrix having a plurality of parallel micro-channels therethrough, the micro-channels being lined with a secondary emissive material.

6. The millimeter wave imaging device recited in claim 1 wherein the accelerating means includes:

an electron focusing lens to demagnify the electron image while keeping the image order.

7. The millimeter wave imaging device recited in claim 1 wherein the display means includes:

a phosphor screen for direct readout of the amplified electron image.

8. The millimeter wave imaging device recited in claim 1 wherein the display means includes:

a backplate spaced from the output of the amplifier means; and electron-sensitive film adapted for continuous motion past the backplate for direct reading of the amplified electron image.

9. The millimeter wave imaging device recited in claim 1 wherein the display means includes:

a two-dimensional charge-coupled device array mounted in direct contact with the amplifier means for serial readout of the amplified electron image.

10. The millimeter wave imaging device recited in claim 3 wherein the modulating means includes:

a conductor transparent to millimeter wave radiation and coated on the pyroelectric film.

* * * * *